United States Patent [19]

Slywka

[11] 4,124,045

[45] Nov. 7, 1978

[54] CONTAINER FILLING APPARATUS FOR VISCOUS MATERIAL

[75] Inventor: Michael Slywka, Parma, Ohio

[73] Assignee: The Gibson-Homans Company, Cleveland, Ohio

[21] Appl. No.: 799,686

[22] Filed: May 23, 1977

[51] Int. Cl.[2] ..... B65B 43/52

[52] U.S. Cl. ..... 141/129; 222/318

[58] Field of Search ..... 141/129–191, 141/4–8; 222/318

[56] References Cited

U.S. PATENT DOCUMENTS 3,795,352 3/1974 Lewis ..... 222/318

FOREIGN PATENT DOCUMENTS 1,146,394 3/1963 Fed. Rep. of Germany ..... 222/318

*Primary Examiner*—Houston S. Bell, Jr.

*Attorney, Agent, or Firm*—McNenny, Pearne, Gordon, Gail, Dickinson & Schiller

[57] ABSTRACT

Apparatus is provided for uniformly filling a succession of containers with highly viscous fluid such as asphalt or plastic roof cement at high fill rates. A constantly running pump of constant discharge rate forces the viscous fill fluid along a descending pressure gradient through a recirculation circuit leading to a dispensing station midway along the descending pressure gradient and leading back from the dispensing station along a return path to fluid supply means for the pump. Timed discharge in the form of timed bleeding from the recirculation circuit at the dispensing station accomplishes fast, smooth, and stable initiation and termination of dispensing action. Adjustable metering of the return path gives further versatility to the system. A simple slideway conveyor for the containers being filled contributes to the cost savings achieved by the invention.

5 Claims, 4 Drawing Figures

CONTAINER FILLING APPARATUS FOR VISCOUS MATERIAL

Figure 1:
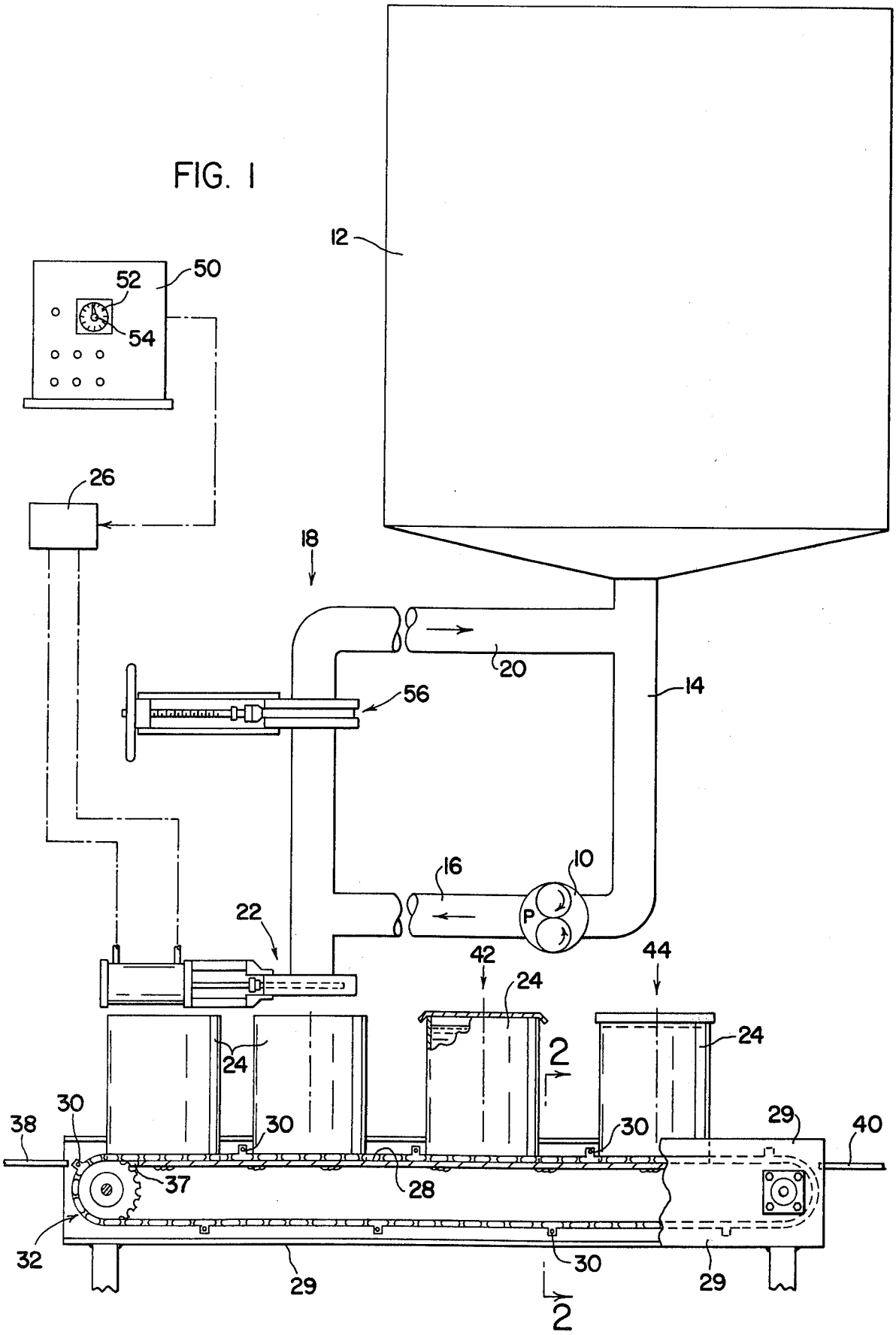

This invention relates to apparatus for uniformly filling a succession of containers with highly viscous fluid such as asphalt and the like at high fill rates.

The invention has been used to fill five-gallon containers with plastic roof cement of a viscosity of approximately 400,000 S.S.U. at 125° F. (and approximately 8,000,000 at 80° F.) at a rate of 8 cans per minute. The apparatus is lower in cost than prior art apparatus of substantially lower fill-rate capacity.

Prior art filling apparatus for viscous fluids has generally measured each charge or fill by weighing the container being filled or by pre-measuring the charge in a filling station. Both approaches have the disadvantage of complexity.

Weighing the container being filled requires that a weighing scale be incorporated in any horizontal conveying system that leads the succession of containers being filled past the various stations required, such as dispensing, covering and crimping. This in turn implies that vertical movement of the scale must be accommodated by the conveying system, requiring mechanism that tends to limit conveying speed and is costly and complicated. These drawbacks are serious enough so that dispensers for viscous liquids are sill marketed today which rely on an operator to manually manipulate the succession of containers onto and/or off of scales at the dispensing station.

Pre-measuring the charge severely limits line speed of a dispensing line. For example, hydraulic fluid supplied to one side of a piston for a pre-measuring chamber at 1500 p.s.i. through a ¾ inch line is limited to a maximum flow of 11 gallons per minute, equivalently limiting the fill rate. Pneumatic actuation of a piston for a pre-measuring chamber is limited by practical considerations to pressures not greatly exceeding 100 p.s.i.

The present invention avoids these limitations of prior art design of fill systems for highly viscous materials. Instead of relying on weighing or on use of a pre-measuring chamber, the present invention relies on timed discharge. While timed discharge has been used for fill systems of various types, it is not believed to have been used successfully for highly viscous fluids because of the failure to provide for fast, smooth, and stable initiation and termination of dispensing action when attempting to dispense such fluids. The present invention overcomes this failure. According to the invention, a constantly running pump of constant discharge rate forces the viscous fluid along a descending pressure gradient through a recirculation circuit leading to a dispensing station midway along the descending pressure gradient and leading back from the dispensing station along a return path to the fluid supply means for the pump. Timed discharge in the form of timed bleeding from the dispensing station in such a system can be fast, smooth, and stable even when handling materials of extremely high viscosity. Adjustable metering of the return path of the recirculation circuit makes the system versatile for set-up to handle different fluids or the same fluid under different ambient conditions so as to maintain a desired fill rate consistent with maximum speed of line operation, or to "tune" for highest achievable fill rate without unacceptable surging, squirting or splashing of the charge during fill.

The conveying system used with the invention preferably comprises a simple stationary slideway providing both the main support for passing containers and the braking means for halting their advance, and also comprises a relatively light associated endless linkage of pusher members for intermittently advancing the containers. The feasibility of using such a simple conveying arrangement contributes to the overall relative low cost of the filling system of the invention.

Figure 2:
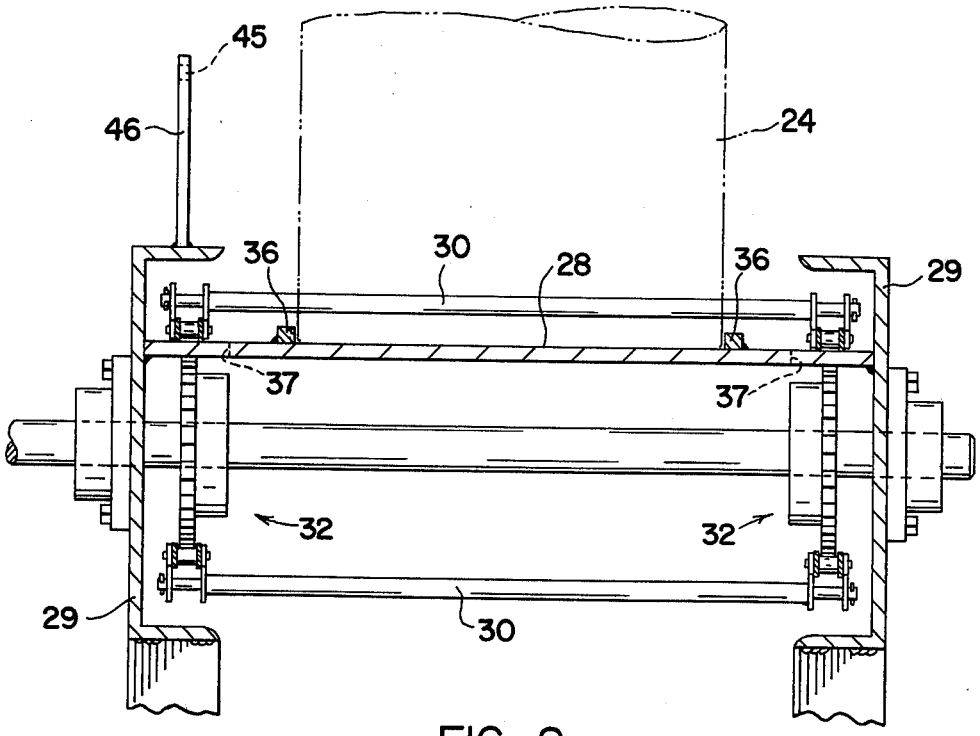
Figure 3:
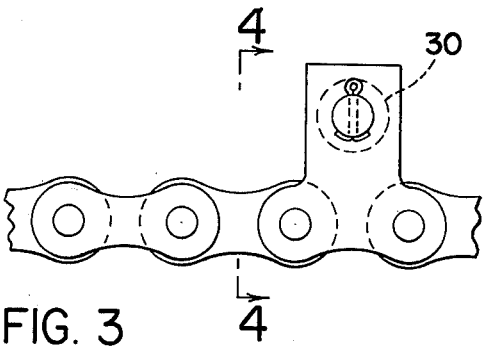
Figure 4:
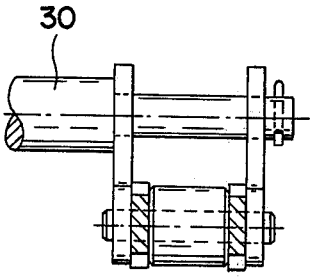

The features and advantages of the invention will be more fully understood from the following more specific descriptions and the accompanying drawings in which FIG. 1 is a partly schematic side elevation of a fill system embodying the invention;

FIG. 2 is somewhat diagrammatic view partly in section taken on the plane of line 2—2 in FIG. 1 on an enlarged scale; and FIGS. 3 and 4 are views on still larger scales showing a detail of the illustrated conveyor.

In the illustrated system a gear pump 10 or other pump capable of handling high viscosity fluid at a constant discharge rate is supplied from a reservoir 12 via a feed line 14, the elements 12 and 14 comprising the fluid supply means for the pump 10. Conduit for the viscous fluid leads along an outfeed path 16 from the output side of the pump 10 to a dispensing station generally indicated at 18, and leads back from the dispensing station along a return path 20 to the fluid supply means, returning either to the feed line 14 as shown or to the reservoir 12. The outfeed and return paths 16 and 20 define and are comprised by a fluid recirculation circuit around which the pump 10 forces the viscous fluid along a descending pressure gradient. By way of example, plastic roof cement of high viscosity may decline 14 p.s.i. per foot at a flow rate of 60 gallons per minute in a 4 inch conduit. The operating pressure of the pump must be high enough, say 120 p.s.i., to force the viscous fluid along the descending pressure gradient and around the recirculation circuit in conduit of the diameter provided, say 4 inches, at the discharge rate of the pump, say 60 gallons per minute. The length of the recirculation path does not exceed the distance along which the pump is capable of forcing the viscous fluid under the given conditions.

A power operated on-off dispensing valve generally indicated at 22 is provided at the dispensing station. The outlet port of this valve opens directly downwardly to discharge dispensing fluid into the open tops of passing containers 24 which for example may be five-gallon cans adapted to receive crimped-on lids applied at a later station beyond the dispensing station 18. The dispensing valve is desirably of the guillotine or sliding gate type powered by an actuating cylinder, as shown, between full open and full closed position. Opening and closing of the valve is controlled by a suitable pneumatic or hydraulic controller 26. Solenoids (not shown) or equivalent elements in the controller 26 are activated and/or deactivated in a conventional manner to control opening and closing of the valve 22 and thus initiate or terminate dispensing of the viscous fluid.

The conveyor for the containers preferably comprises a slideway arrangement which contributes importantly to the overall economy of the dispensing system. A flat slideway 28 supports the bottoms of the containers 24. The containers are advanced by pusher members 30 associated with chain-and-sprocket drives 32 extending along both sides of the slideway and intermittently advanced in unison by any conventional intermittent drive means (not shown) which may comprise for example a motor and brake drive or simply a motor powering any mechanical linkage for converting continuous rotary motion to intermittent motion. The braking demand on any such system is light because braking of the forward advance of the containers 24 is accomplished by friction between them and the slideway. Thus, when the pushers 30 stop at the conclusion of an intermittent advance, the containers continue in free slide for a short distance before coming to rest, leaving the containers slightly advanced beyond the pusher members 30 in the dwell condition of the conveyor, as seen in FIG. 1. This free slide distance can be maintained uniform within a narrow tolerance of small fractions of an inch. By this means the braking requirements on the moving parts of the conveyor system are greatly minimized since the braking action of the moving parts need not absorb the momentum of the containers and their contents, nor need braking be provided against the momentum of bodily moving conveyor elements for supporting the containers, since no such elements are employed.

Accurate positioning of the containers is not important at the initiation of advance. Consequently, from a positioning standpoint, the system can tolerate substantial deformation or springing within the linkage upon engagement and initial advance of the containers so that the maximum instantaneous load on the linkage which is experienced in overcoming the friction between the containers and the slideway and in initiating the forward motion of the containers is minimized by the shock absorbing action of such deformation or springing. In other words, shock absorbing distortions of the linkage which momentarily affect positioning of the containers is acceptable at the initiation of advance. By the end of an advance any such distortions largely or totally disappear and the linkage need not absorb the forces required to brake the containers, as previously explained.

The net result is a substantial lightening and cost reduction of the conveyor linkage system as compared with systems which accomplish advance of containers and contents by carrying the containers over bodily advancing conveyor elements or as compared with any conveyor system where advance of the containers and contents is directly braked and, in particular, as compared with systems involving the provision of scales on the conveying line at the dispensing station.

In the particular apparatus illustrated, the forwardly advancing reaches of the chains of the chain-and-sprocket drives are supported directly on the slideway 28 so that the chains do not sag and the pushers 30 are maintained a uniform distance above the slideway during their advance. The slideway is supported on frame channels 29 and may be suitably cut away at its outside corners, as at the notches 37, to accommodate the sprockets. The pushers 30 may be supported on the chains in any suitable manner, as by special links of the type seen in FIGS. 3 and 4. Containers 24 may be supplied to the slideway 28 by any suitable means, as by a timed pusher and escapement (not shown) which feed the containers transversely from a horizontal infeed chute 38 which runs in a direction perpendicular to the slideway 28. An off-feed chute 40 may be provided. The chutes 38 and 40 are slightly spaced from the ends of the slideway 28 to clear the rise and fall of the pusher members as they travel around the sprockets at the ends of the conveyor reach. Guideway bars or rails 36, shown in FIG. 2 only, may be provided to engage the sides of the containers for guidance. The rails 36 may flare apart at the input end of the conveyor for ready reception of the containers.

The apparatus may include a can lid emplacement station 42 and lid crimping station 44. Lid emplacement is presently performed manually, and lid crimping is performed automatically by conventional automatic crimping apparatus (not shown).

The successive openings of the dispensing valve are correlated to the presentation of successive containers at the dispensing station 18 by any suitable means, which may be simply the sensing by the controller 26 of the completion of an advance. Opening by the dispensing valve may be further conditioned, in the conventional manner, on verification that a container is in fact at a station, as by depression of a sensor or microswitch (not shown) mounted on a bracket at one side of the slideway. The additional operations at later stations may be similarly conditioned on actuation of the additional microswitches or sensors (not shown).

Preferably, the intermittent drive for the conveyor comprises a motor and brake system and the completion of advance is initiated by actuation of the same or another sensor or microswitch (not shown) mounted on the bracket 46 and which, when engaged by an advancing container, causes the brake of the drive to be applied. The position of this microswitch is adjustable along a slot 45 extending a short distance longitudinally along the conveyor to thereby adjust the indexing of the pusher members 30 at their stopping point and thereby the indexing of the containers at their stopping point. Such adjustment of container indexing may be desirable on set up or during a run. It may be particularly useful when there is changeover from one size or weight of fill to another, since the distance containers continue to slide beyond the pusher members upon stopping of the latter is likely to vary upon such a changeover.

A timer associated with a control panel 50 is set by the operator for a given fill time, preferably indicated in seconds on a dial or scale 52, the setting being accomplished by manipulation of a wheel or knob 54 which controls any suitable conventional adjustable electronic or fluid timing means suitable for association with the controller 26. Additional knobs and switches may control line speed if a variable drive is used and may turn on and off various parts of the system such as the pump and the conveyor.

When the dispensing valve 22 opens, the timer commences to time out and when this occurs the controller closes the valve 22, thus determining the controlling the fill interval.

When the dispensing valve 22 opens, the flow of viscous fluid being pumped at a constant flow rate around the recirculation cycle is bled by discharge from the valve 22. As the valve 22 opens, this bleeding and discharge commences in a fast, smooth and stable manner, and as the valve 22 closes the bleeding and discharge is likewise quickly and smoothly terminated in a stable manner.

The provision of a metering valve 56 increases the versatility of the system and is a practical necessity for set-up in many applications. Such valve is provided in the return line 20 and should be located at the dispensing station. Such valve is adjustable, as by manipulation of the illustrated handwheel, for adjustably defining a minor cross-section of the flow path in the return portion. The system which includes a metering valve is designed with a conduit cross-section greater than that required to allow the pump to circulate the viscous fluid under the other given conditions. Consequently the rate of discharge per unit time from the dispensing valve when it is open can be adjusted by either partially closing off or opening up the metering valve to correspondingly increase or decrease the rate of discharge from the dispensing valve.

Thus in setting up a line, the operator may partially close off the metering valve 56 to increase the fill rate per unit time, and may correspondingly shorten the timing interval for fill which is to be set at the control panel 50. A shortened timing interval for fill in turn allows the cycle time on the conveyor to be decreased if adjustments or controls are provided to allow this. Such partial closing off may be continued until the viscous fluid begins to surge or splash or squirt to one side, or until some other limitation of the apparatus is exceeded, whereupon the adjustment is backed off slightly. Conversely, if such surging, splashing or squirting is initially encountered on set-up, the operator opens up the metering valve 56 until the dispensing action becomes smooth. This may require that the timing interval for fill be increased and perhaps that conveyor cycle time be decreased.

Under generally encountered conditions, a four inch diameter conduit for the recirculating circuit allows for efficient dispensing of very high viscosity fluids such as the plastic roof cements previously mentioned. However systems using four inch line have been used advantageously for dispensing fluids having viscosities of only several thousand S.S.U. Nevertheless, the greatest advantageousness of the invention compared to the prior art, in respect of fill rates, is in connection with dispensing of materials at the highest end of the viscosity scale.

The invention is not limited to all particulars of the above disclosure but is defined by the following claims.

What is claimed is:

1. In apparatus for filling a succession of containers with highly viscous fluid at a high fill rate, pump means having a constant discharge rate and a sufficiently high operating discharge pressure to force the fluid at the constant discharge rate along a descending pressure gradient through a given distance in a conduit of a given diameter, fluid supply means supplying the fluid to said pump means at a reference pressure, a fluid recirculation circuit of a length not exceeding said given distance and comprising conduit of not less than said given diameter and leading from the output side of the pump means to a dispensing station midway along said descending pressure gradient and leading back from said dispensing station along a return path to said fluid supply means, the fluid recirculation circuit by virtue of its selected length and diameter and the highly viscous nature of the fluid requiring said pump to discharge fluid at a pressure substantially higher than said reference pressure, means for periodically presenting containers to the dispensing station, a power operated dispensing valve at the dispensing station for periodically bleeding the recirculation circuit to dispense fluid directly from the recirculation circuit into periodically presented containers, means for correlating the opening of the dispensing valve to the presentation of a container, timing means for controlling the interval the dispensing valve remains open during the presentation of the container, said pump being arranged to operate continuously during cycles of opening and closing of said dispensing valve, the fluid recirculation circuit and dispensing valve being constructed and arranged relative to one another and with regard to their respective resistances to viscous fluid flow such that pressures greater than said reference pressure continuously exist in said return path so that opening of said power operated dispensing valve results in bleeding some but not all fluid away from circulation back to the fluid supply means.

2. Apparatus as in claim 1 in which the diameter of said conduit comprised by said fluid recirculation circuit exceeds said given diameter, a metering valve in the return portion of said recirculation circuit for defining a minor cross-section of the flow path in the return portion, the metering valve being adjustable to progressively reduce the minor cross-section, and increase its resistance to viscous fluid flow through the return circuit portion and thereby develop a corresponding increase in pressure at the dispensing station and an increase in the dispensing flow rate through the dispensing valve.

3. Apparatus as in claim 1, said timing means including means for adjusting said interval throughout a continuous range to thereby vary the level of fill of passing containers throughout a continuous range for infinite adjustment thereof.

4. Apparatus as in claim 1, the means for periodically presenting containers comprising a fixed slideway passing under the dispensing station and slidably receiving a succession of containers, an endless linkage of regularly spaced pusher members extending over the slideway in the feed direction and extending along a return reach, and means for intermittently advancing the endless linkage for advancing each of such succession of containers along the slideway to the dispensing station, allowing the container to self-brake there and to dwell there during filling, and then advancing it from the station, and for similarly manipulating the container at succeeding stations.

5. In apparatus for filling a succession of containers with viscous fluid at a high fill rate, pump means having a constant discharge rate and a sufficiently high operating discharge pressure to force the viscous fluid, at the constant discharge rate, along a descending pressure gradient, through a given distance in a conduit of given diameter, a fluid recirculation circuit of a length not exceeding said given distance and comprising conduit exceeding said given diameter and leading from the output side of the pump means to a dispensing station midway along said descending pressure gradient and leading back from said dispensing station along a return path to said fluid supply means, a metering valve in the return portion of said recirculation circuit for defining a minor cross-section of the flow path in the return portion, the metering valve being adjustable to progressively reduce the minor cross-section, means for periodically presenting containers to the dispensing station comprising a slideway passing under the dispensing station and slidably receiving a succession of containers, an endless linkage of regularly spaced pusher members extending over the slideway in the feed direction and extending along a return reach, and means for intermittently advancing the endless linkage for advancing each of said succession of containers along the slideway to the dispensing station, allowing the container to self-brake there and to dwell there during filling, and then advancing it from the station, and for similarly manipulating the container at succeeding stations, a power operated dispensing valve at the dispensing station for periodically bleeding some but not all fluid away from recirculation back to the fluid supply means and dispensing it to containers, means for correlating the opening of the dispensing valve to the presentation of a container, timing means for controlling the interval the dispensing valve remains open during the presentation of the container, and including means for adjusting said interval throughout a continuous range to thereby vary the level of fill of passing containers throughout a continuous range for precise adjustment thereof.

* * * * *